US008672545B1

(12) United States Patent
Norman et al.

(10) Patent No.: US 8,672,545 B1
(45) Date of Patent: Mar. 18, 2014

(54) LINER BAG FOR WARMING DEVICE

(71) Applicant: Neonatal Product Group, Inc., Overland Park, KS (US)

(72) Inventors: Scott Norman, Stilwell, KS (US); Mark Petheram, Overland Park, KS (US)

(73) Assignee: Neonatal Product Group, Inc., Overland Park, KS (US)

( * ) Notice: Subject to any disclaimer, the term of this patent is extended or adjusted under 35 U.S.C. 154(b) by 0 days.

(21) Appl. No.: 13/662,629

(22) Filed: Oct. 29, 2012

(51) Int. Cl.
*B65D 30/22* (2006.01)
*B65D 30/08* (2006.01)

(52) U.S. Cl.
USPC ..... 383/38; 383/109; 206/459.1

(58) Field of Classification Search
USPC ..... 206/459.1; 383/109, 32, 38, 63, 104, 383/122, 210, 120
See application file for complete search history.

(56) References Cited

U.S. PATENT DOCUMENTS

| | | | | |
|---|---|---|---|---|
| 2,925,719 | A * | 2/1960 | Robbins et al. | 62/4 |
| 3,887,346 | A * | 6/1975 | Erdman | 62/4 |
| 4,993,844 | A * | 2/1991 | Robinson et al. | 383/38 |
| 5,791,485 | A * | 8/1998 | Carbonneau | 206/720 |
| 5,804,265 | A * | 9/1998 | Saad et al. | 428/35.2 |
| 6,874,938 | B2 * | 4/2005 | Price et al. | 383/109 |
| 7,011,615 | B2 * | 3/2006 | Price et al. | 493/210 |
| 7,556,429 | B2 * | 7/2009 | Taheri | 383/38 |
| 7,674,041 | B2 * | 3/2010 | Frayne | 383/101 |
| 2002/0088825 | A1 * | 7/2002 | Laverdure | 222/107 |
| 2006/0291756 | A1 * | 12/2006 | Thomas et al. | 383/105 |
| 2007/0189639 | A1 * | 8/2007 | Revness | 383/37 |
| 2010/0247712 | A1 * | 9/2010 | Rudolph | 426/61 |

* cited by examiner

*Primary Examiner* — Steven A. Reynolds
*Assistant Examiner* — Ernesto Grano
(74) *Attorney, Agent, or Firm* — Hovey Williams LLP

(57) ABSTRACT

A liner bag for use with a warming device has an inner bag and an outer bag. The inner bag has an inner chamber for receiving and at least partially enclosing a container. The outer bag has an outer chamber that at least partially encloses the inner bag and that receives and encloses a heat transfer fluid that transfers heat to the container. The side edges of the inner bag are joined to the side edges of the outer bag but the front face, rear face, and bottom edge of the inner bag are not joined to the front face, rear face, and bottom edge of the outer bag so that the heat transfer fluid may flow between the outer bag and inner bag for more effectively transferring heat to the inner bag and the container enclosed in the inner bag. The liner bag may also have an anti-microbial agent for disinfecting the heat transfer fluid placed in the outer bag.

24 Claims, 5 Drawing Sheets

LINER BAG FOR WARMING DEVICE

BACKGROUND

Breast milk, baby formula, and other nutritional substances for babies are ideally fed at temperatures near 98 degrees F. to simulate the temperature of a mother's body and therefore the temperature of natural breast milk. However, many women express their breast milk and refrigerate and/or freeze it for later use, and other women feed their babies formula instead of breast milk. In all cases, the milk or formula should be warmed to body temperature before being fed to a baby, especially if the baby was born pre-mature or suffers from other health problems. Various devices have been developed for warming milk, formula, and other food substances for babies, but such devices suffer from various limitations that limit their utility.

SUMMARY

One known device for warming breast milk, formula, etc. includes one or more electrically powered heating wells in which milk bottles or other containers may be placed. Heat from a well is passed to a container placed therein via conduction to warm the milk in the container. Unfortunately, such warming devices can overheat portions of the container in direct contact with the well and underheat other portions of the container, resulting in hot and cold spots in the milk. These warming devices must also be cleaned and disinfected frequently because milk can occasionally drip from the containers into the heating wells and then transfer to other containers subsequently placed in the wells.

Applicant has discovered that liner bags may be used to increase the effectiveness of the above-described warming devices. A food container may be placed in a liner bag and the liner bag may then be placed in one of the heating wells of the warming device. The liner bag helps to more evenly distribute heat to the food container and prevents milk and other substances from transferring from the containers to the heating wells.

Embodiments of the present invention provide an improved liner bag broadly comprising an inner bag and an outer bag or jacketed bag/liner. The inner bag is configured for receiving and enclosing a container of breast milk, formula, or other food substance. The outer bag at least partially surrounds the inner bag and is configured for receiving water or other heat transfer fluid for warming the inner bag and the container enclosed therein.

An embodiment of the inner bag has a front face, a rear face, closed side edges, a closed bottom edge, and an open top edge that cooperatively define an inner chamber for receiving and at least partially enclosing the milk container or other container. An embodiment of the outer bag has a front face, a rear face, closed side edges, a closed bottom edge, and an open sealable top edge that cooperatively define an outer chamber that at least partially encloses the inner bag and that receives and encloses the water or other heat transfer fluid. Advantageously, the side edges of the inner bag are joined to the side edges of the outer bag, but the front face, rear face, and bottom edge of the inner bag are not joined to the front face, rear face, and bottom edge of the outer bag so that the heat transfer fluid may flow between the outer bag and inner bag and at least partially surround the front face, rear face and bottom edge of the inner bag for more effectively transferring heat to the inner bag and the container enclosed in the inner bag.

In use, the chamber of the outer bag is filled with water or any other heat transfer fluid up to a fill-line. The top edge of the outer bag is sealed with a zip lock mechanism or other sealing device to retain the fluid in the chamber. A bottle of milk or other container is placed in the chamber of the inner bag. The top edge of the inner bag may also be sealed. The liner bag is then placed in a heating well of a warming device. Contact pressure between the liner bag and the heating well cause the heat transfer fluid in the outer bag to rise and surround significant portions of the inner bag. Heat from the heating well warms the heat transfer fluid, which in turn evenly warms the inner bag and the container enclosed therein.

Some embodiments of the liner bag may also include an anti-microbial agent for disinfecting the water or other heat transfer fluid placed in the chamber of the outer bag. In one embodiment, the anti-microbial agent is impregnated in the walls of the outer bag. In other embodiments, the anti-microbial agent is impregnated in a strip applied to an inside wall of the outer bag. The anti-microbial strip may also indicate when the anti-microbial agent loses its effectiveness so that a user may know when to discontinue use of the bag. For example, the strip may change color after being immersed in water or other heat transfer liquid for a predetermined amount of time to indicate the liner bag should be discarded and replaced with a new bag.

Some embodiments of the liner bag further comprise a temperature indicator strip applied to the inner bag or the outer bag for indicating a temperature of the heat transfer fluid. The temperature indicator strip may change colors or otherwise change states when the inner bag reaches a desired temperature such as 98° F.

In some embodiments, the inner and outer bags may be color coded to indicate where to place the milk container and heat transfer fluid. For example, the inner bag, or at least the sealable top edge thereof, may be colored orange to indicate that a food container should be placed in its inner chamber, and the outer bag, or at least the sealable top edge thereof, may be colored blue to indicate that water or other heat transfer fluids should be placed in its chamber.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
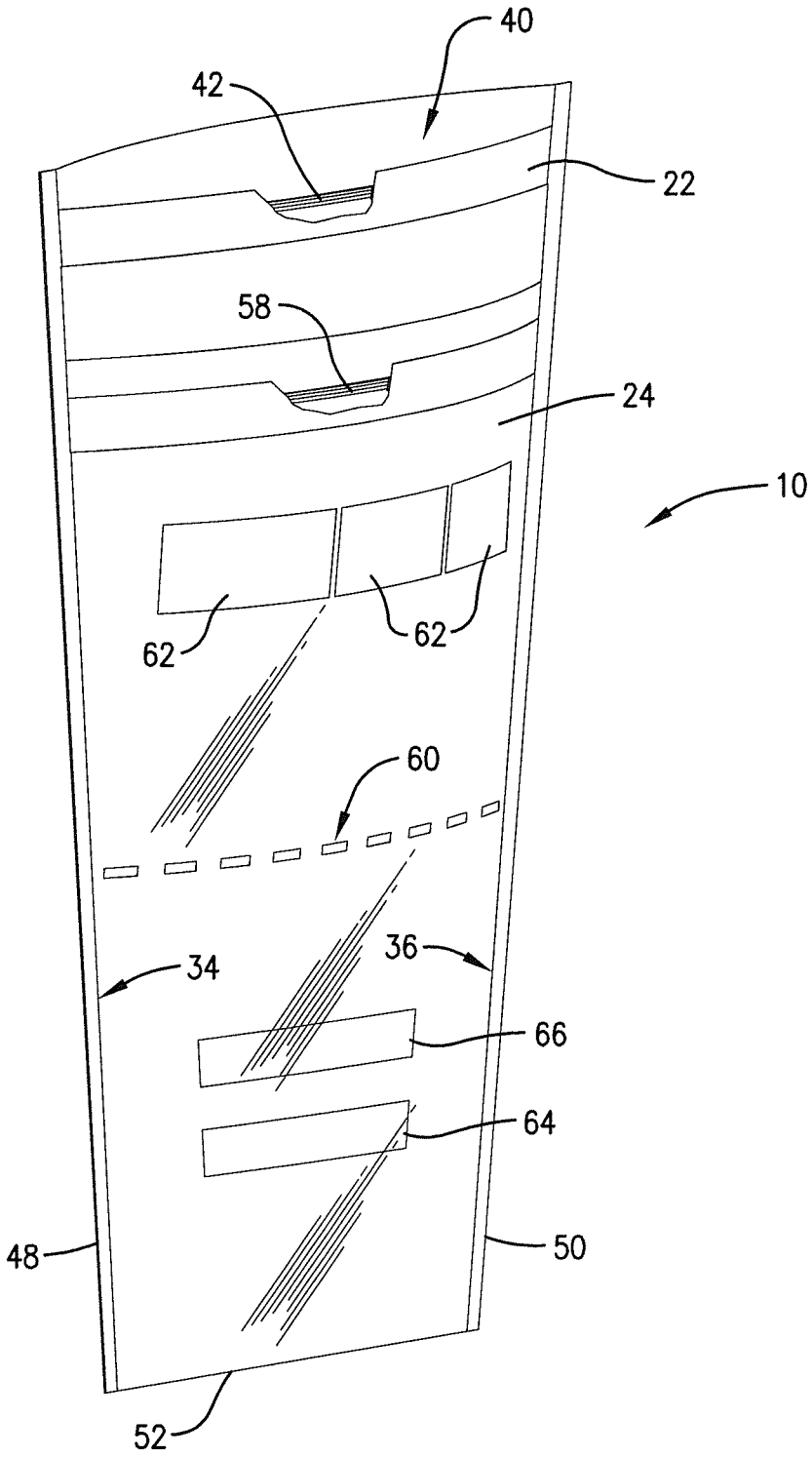
FIG. 1 is a front elevational view of a liner bag constructed in accordance with an embodiment of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 3:
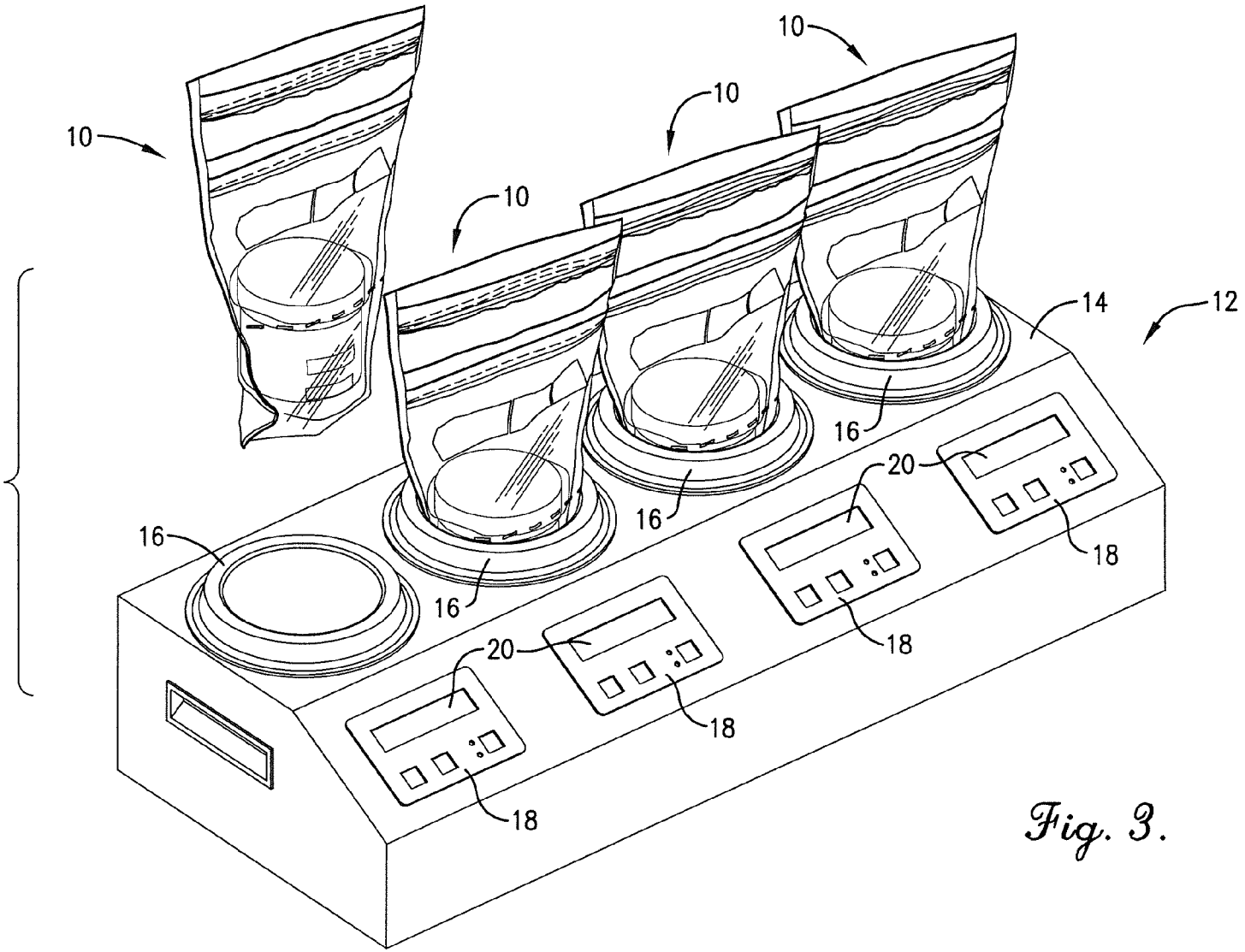
FIG. 3 is a perspective view of several of the liner bags shown in use with an exemplary warming device.

Embodiments of the present invention provide a liner bag 10 for use with a milk warming device 12 as shown in FIG. 3. The exemplary warming device 12 includes a housing 14 which encloses one or more electrically-powered resistive type heaters. One or more heating wells 16 are positioned in a top surface of the housing 14 for receiving and warming the liner bags 10. The warming device 12 may also include control circuitry for maintaining the temperature of the wells 16 and associated controls such as buttons or switches 18 for adjusting the control circuitry. An LED display 20 or other indicator may be positioned next to each well 16 for displaying information about a container in the well. For example, the indicator 20 may display the name of the baby to be fed with the container, the parents' names, and/or other identification or contact information. The warming device 12 shown in FIG. 3 is merely one example of a device that may be used with the liner bags of the present invention. The scope of the present invention is not limited in any way by the illustrated warming device, as the liner bag 10 may be used with any warming or heating device.

The liner bag 10 of the present invention increases the effectiveness of the above-described warming device 12 by more evenly distributing heat to food containers enclosed in the liner bag as described in more detail below. The liner bag 10 also enhances the cleanliness and sterilization of the warming device 12 by preventing milk and other substances from transferring from the containers to the heating wells 16. The liner bag also isolates waterborne microbes from the feeding and hospital NICU.

Figure 4:
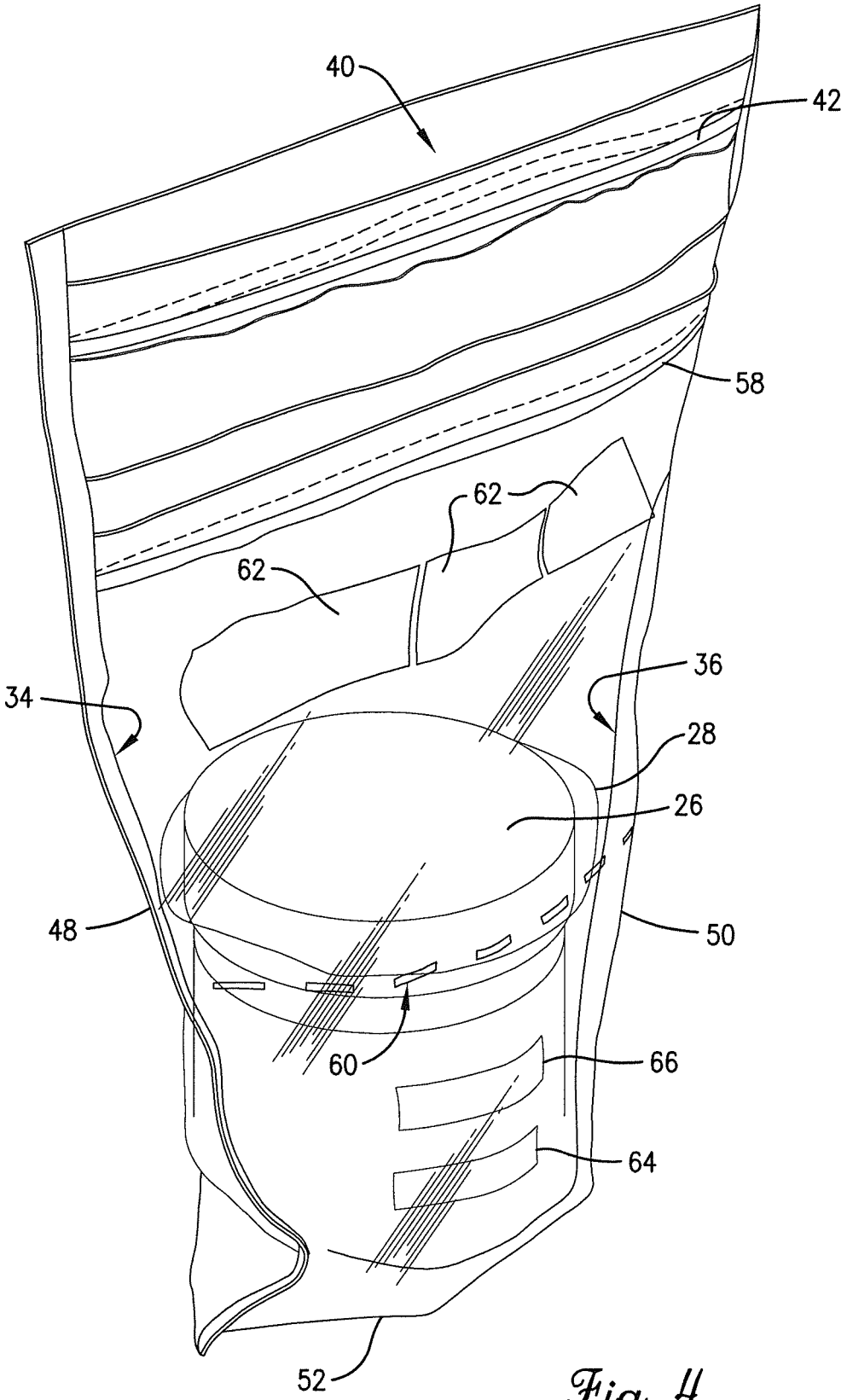
FIG. 4 is a perspective view of the liner bag shown with a milk container therein and filled with water or other heat transfer fluid.

Specific embodiments of the liner bag 10 will now be described in more detail with initial reference to FIGS. 1 and 2. An embodiment of the liner bag 10 broadly comprises an inner bag 22 integrally formed with and enclosed within an outer bag 24. As best shown in FIG. 4, the inner bag 22 is configured for receiving and enclosing a container 26 of breast milk, formula, or other food substance and the outer bag 24 is configured for receiving water or other heat transfer fluid 28 for warming the inner bag 22 and the container 26 enclosed therein. Both the inner bag 22 and the outer bag 24 may be constructed of thin, flexible, recyclable plastic material such as polypropylene or any other plastic so long as the material is substantially BPA free, and may be formed in various different shapes and sizes. The bags may also be formed of materials with additive agents and/or resins such as antimicrobial and/or anti-infective formulations.

Figure 2:
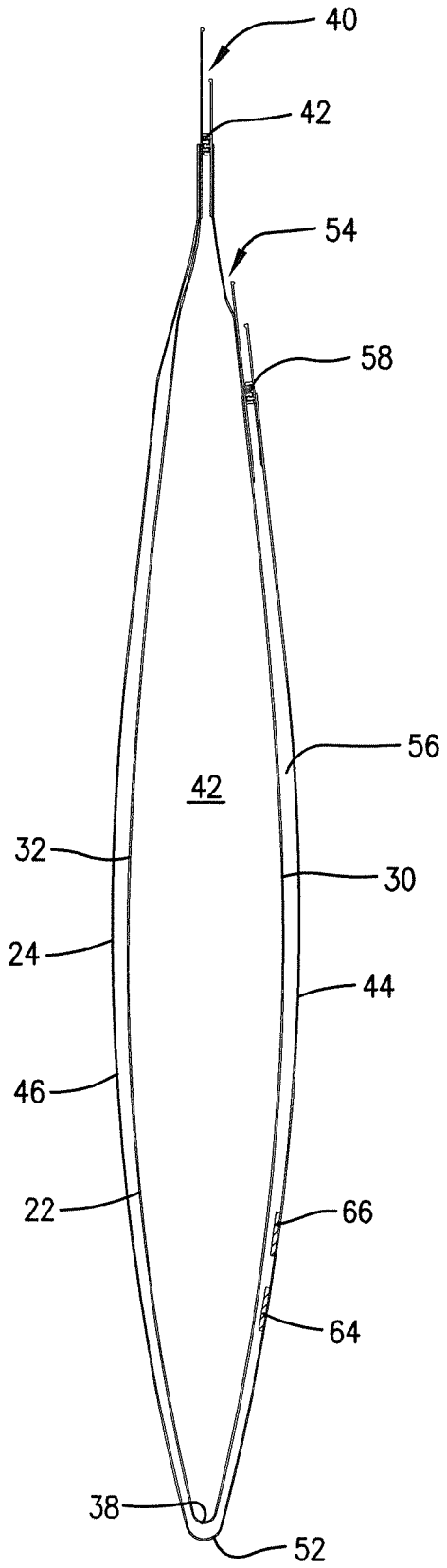
FIG. 2 is a vertical side sectional view of the liner bag.
Figure 5:
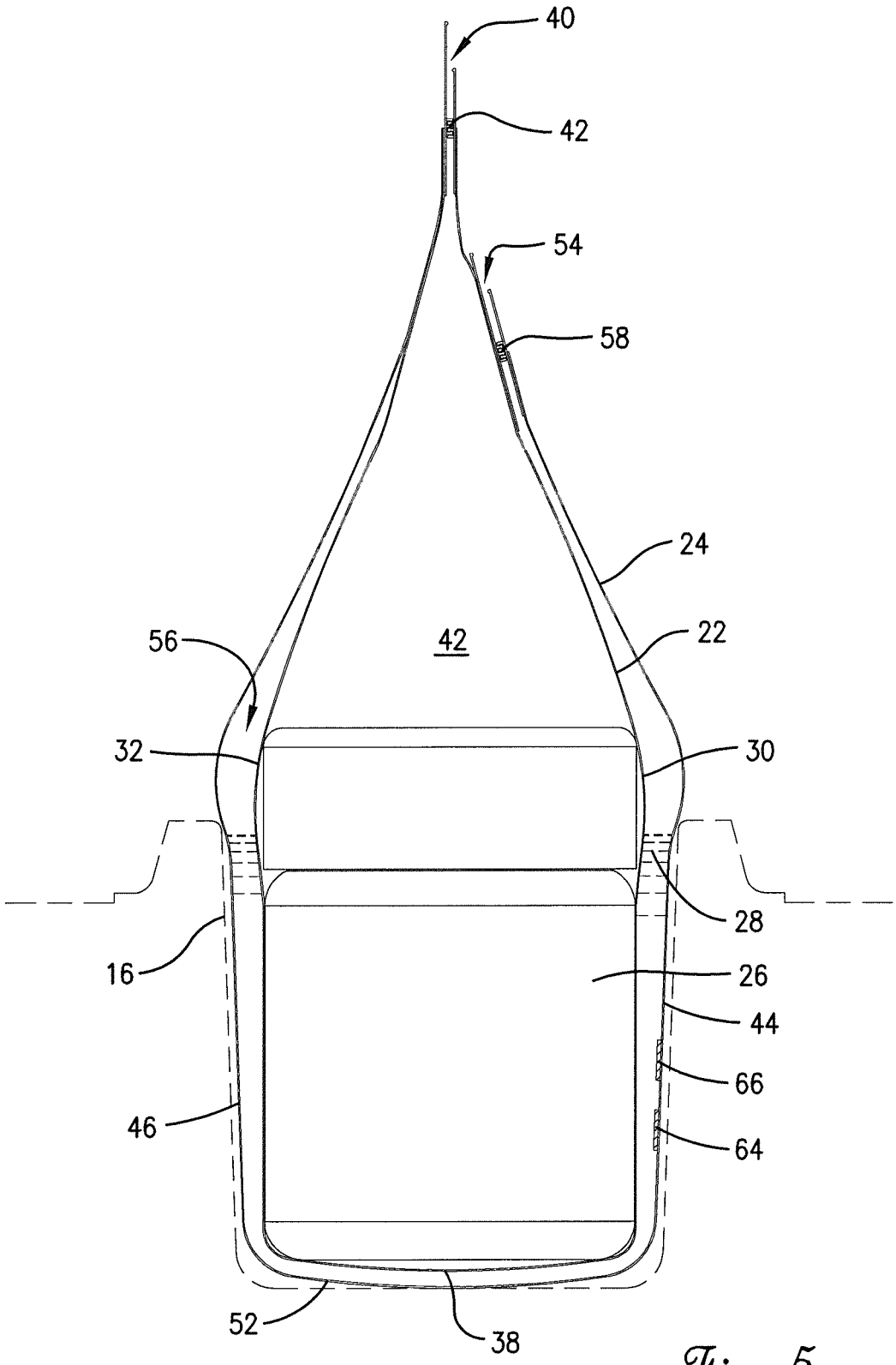
FIG. 5 is a vertical side sectional view of the liner bag with one of the wells of the warming device shown in dashed lines.

In more detail, the inner bag 22 has a front face 30 and a rear face 32 as best shown in FIGS. 2 and 5, closed side edges 34, 36 as best shown in FIGS. 1 and 4, a closed bottom edge 38 as best shown in FIGS. 2 and 5, and an open top edge 40 as best shown in FIGS. 2 and 5. The faces 30, 32 and edges 34, 36, 38, 40 cooperatively define an inner chamber 42 for receiving and at least partially enclosing the container 26. A zip lock closure mechanism 42 may be attached to the top edge 40 for sealing the inner chamber 42. Alternatively, the top edge 40 may be sealed with adhesives or other fasteners.

An embodiment of the outer bag 24 also has a front face 44 and a rear face 46 as best shown in FIGS. 2 and 5, closed side edges 48, 50 as best shown in FIGS. 1 and 4, a closed bottom edge 52 as best shown in FIGS. 2 and 5, and an open sealable top edge 54 as best shown in FIGS. 2 and 5. The faces 44, 46 and edges 48, 50, 52 cooperatively define an outer chamber 56 that at least partially encloses the inner bag 22 and that receives and encloses the water or other heat transfer fluid 28. A zip lock closure mechanism 58 may be attached to the top edge 54 for sealing the chamber 56. Alternatively, the top edge may be sealed with adhesives or other fasteners. The bottom edge 52 of the outer bag 24 may be provided with a gusset or inwardly folded edge to allow the liner bag 10 to stand upright when the chamber 56 is filled with heat transfer fluid.

In one embodiment, the side edges 34, 36 of the inner bag 22 are joined to the side edges 48, 50 of the outer bag 24, but the front face 30, rear face 32, and bottom edge 38 of the inner 22 bag are not joined to the front face 44, rear face 46, and bottom edge 52 of the outer bag 24. This allows the water or other heat transfer fluid 28 in the chamber 56 to flow between the outer bag 24 and the inner bag 22 and at least partially surround the front face 30, rear face 32 and bottom edge 38 of the inner bag 22 as in a jacketed fashion for more effectively transferring heat to the inner bag 22 and the container 26 enclosed in the inner bag.

A fill line 60 may be printed on the front face 44 of the outer bag 24 or elsewhere to indicate the proper amount of heat transfer fluid 28 to add to the bag. Marking areas 62 may also be printed on the front face 44 for writing notes for indicating the name of the baby to be fed with the contents of the container, the name of the nurse or other person responsible for the feeding, an expiration date, etc.

The top edges 40, 54 of the inner and outer bags are preferably wider than the bottom edges so that the inner bag tapers inwardly from the top to the bottom as best shown in FIG. 1. This allows the liner bag 10 to fit snugly within a well 16 of the warming device 12 while still being easy to remove from the well. This provides maximum thermal conductivity between the well and the liner bag 10. In one specific embodiment, the top edges are between 5 and 7" wide, the bottom edges are between 3 and 5" wide, and the overall liner bag is between 7 and 11" tall.

In other embodiments, the bottom of the liner bag may be formed of stiffer and/or thicker plastic. In still other embodiments, a saucer or disc may be attached to the bottom of the liner bag to allow the bottom of the liner bag to contact the bottom of the well of the heating device to assist in heat transfer to the bag.

Some embodiments of the liner bag 10 may include an anti-microbial and/or anti-infective agent for disinfecting the water or other heat transfer fluid 28 placed in the chamber 56 of the outer bag. In one embodiment, the anti-microbial agent is impregnated in an inside wall of the front face 44 or rear face 46 of the outer bag.

In other embodiments, the anti-microbial and/or anti-infective agent may be impregnated in a strip 64 printed on or adhered to an inside wall of the outer bag. The anti-microbial strip 64 may also indicate when the anti-microbial agent loses its effectiveness so that a user my know when to discontinue use of the bag. For example, the strip 64 may change color after being immersed in water or other heat transfer liquid for a predetermined amount of time to indicate the liner bag should be discarded and replaced with a new bag. In one embodiment, the strip 64 may initially be colored blue and may change to red after being exposed to water or other heat transfer liquid for twelve hours or more. In other embodiments, the strip may have lettering such as "replace" or "discard" covered by a coating that dissolves after being exposed to fluids for a pre-determined amount of time to expose the lettering.

Some embodiments of the liner bag may further comprise a temperature indicator strip 66 applied to the inner bag or the outer bag for indicating a temperature of the heat transfer fluid. The temperature indicator strip may change colors or otherwise change states then the inner bag reaches a desired temperature such as 98° F.

In some embodiments, the inner and outer bags may be color coded to indicate where to place the milk container and heating fluid. For example, the inner bag 22, or at least the sealable top edge 40 thereof, may be colored orange to indicate that a food container should be placed in its inner chamber 42, and the outer bag 24, or at least the sealable top edge 54 thereof, may be colored blue to indicate that water or other heating fluids should be placed in its inner chamber 56.

In use, water or any other heat transfer fluid 28 is placed in the chamber 56 of the outer bag 24 up to the fill-line 60. The top edge 54 of the outer bag is sealed with the zip lock mechanism 58 or other sealing device to retain the fluid in the chamber. The milk container 26 or other container is placed in the chamber 42 of the inner bag 22. The top edge 40 of the inner bag may also be sealed with the zip lock mechanism 42. The entire liner bag 10 is then placed in a heating well 16 of the heating device 12. Contact pressure between the liner bag 10 and the heating well 16 cause the heat transfer fluid in the outer bag 24 to rise and surround significant portions of the inner bag 22. Heat from the heating well warms the heat transfer fluid, which in turn evenly warms the inner bag 22 and the container 26 enclosed therein.

In an alternative embodiment, the chamber 56 of the outer bag 24 may come pre-filled with water, sterile water, or any other heat transfer fluid. In such an embodiment, the top edge of the outer bag is sealed so that no closure mechanism is needed. In another embodiment, the chamber 56 may be filled with a self-warming fluid, such as the fluids in hand and feet warming pouches, that heats to a specified heating temperature or range upon agitation or other activation. Advantageously, such an embodiment does not require the heating device 12.

Although the invention has been described with reference to the embodiments illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A liner bag for placement in a warming device, the liner bag comprising:

an inner bag comprising a front face, a rear face, closed side edges, a closed bottom, and an open top edge that cooperatively define an inner chamber for receiving and at least partially enclosing a container; and an outer bag jacket around the inner bag and comprising a front face, a rear face, closed side edges, a closed bottom, and an open sealable top edge that cooperatively define an outer chamber that at least partially encloses the inner bag and that is configured for receiving a heat transfer fluid that transfers heat from the warming device to the inner bag and the container enclosed therein, wherein the top edges of the outer bag jacket and the inner bag have a width ranging from approximately 5 inches to approximately 7 inches, the closed bottoms have a width ranging from approximately 3 inches to approximately 5 inches, and the liner bag has a height ranging from approximately 7 inches to approximately 11 inches, and the closed bottoms of the outer bag jacket and the inner bag are formed from material that is greater in thickness than the material of the rest of the liner bag.

2. The liner bag of claim 1, wherein the side edges of the inner bag are joined to the side edges of the outer bag but the front face, rear face, and bottom edge of the inner bag are not joined to the front face, rear face, and closed bottom of the outer bag so that the heat transfer fluid may flow between the outer bag and the inner bag and at least partially surround the front face, rear face and closed bottom of the inner bag for more effectively transferring heat to the inner bag and the container enclosed therein.

3. The liner bag of claim 1, the outer bag further comprising an anti-microbial, anti-infective type agent for disinfecting the heat transfer fluid placed in the outer chamber.

4. The liner bag of claim 1, wherein the anti-microbial agent is impregnated in the front and/or rear face of the inner bag and/or the outer bag.

5. The liner bag of claim 1, wherein the anti-microbial agent is impregnated in a strip applied to an inner wall of the front and/or rear face of the inner bag and/or the outer bag.

6. The liner bag of claim 5, wherein the strip indicates when the anti-microbial agent loses its effectiveness so that a user may know when to discontinue use of the liner bag.

7. The liner bag of claim 5, further comprising a temperature indicator strip applied to the inner bag and/or the outer bag for indicating a temperature of the heat transfer fluid.

8. The liner bag of claim 1, wherein the top edge of the inner bag and the top edge of the outer bag each include a zip-lock closure for sealing the inner and outer chambers.

9. The liner bag of claim 1, wherein the heat transfer fluid is pre-loaded and sealed in the outer chamber of the outer bag.

10. The liner bag of claim 1, wherein a fill-line is applied to the inner bag or the outer bag to indicate how much heat transfer fluid to add to the outer chamber of the outer bag.

11. A liner bag for placement in a warming device, the liner bag comprising:

an inner bag comprising a front face, a rear face, closed side edges, a closed bottom, and an open top edge that cooperatively define an inner chamber for receiving and at least partially enclosing a container;

an outer bag comprising a front face, a rear face, closed side edges, a closed bottom, and an open sealable top edge that cooperatively define an outer chamber that at least partially encloses the inner bag and that receives and encloses a heat transfer fluid that transfers heat from the warming device to the container, wherein the side edges of the inner bag are joined to the side edges of the outer bag but the front face, rear face, and closed bottom of the inner bag are not joined to the front face, rear face, and closed bottom of the outer bag so that the heat transfer fluid may flow between the outer bag and inner bag and at least partially surround the front face, rear face and closed bottom of the inner bag for more effectively transferring heat to the inner bag and the container enclosed in the inner bag, and wherein the top edges of the outer bag and the inner bag have a width ranging from approximately 5 inches to approximately 7 inches, the closed bottoms have a width ranging from approximately 3 inches to approximately 5 inches, and the liner bag has a height ranging from approximately 7 inches to approximately 11 inches, and the closed bottoms of the outer bag jacket and the inner bag are formed from material that is greater in thickness than the material of the rest of the liner bag; and an anti-microbial agent for disinfecting the heat transfer fluid placed in the outer chamber of the outer bag.

12. The liner bag of claim 11, wherein the anti-microbial agent is impregnated in an inner wall of the front and/or rear face of the inner bag and/or the outer bag.

13. The liner bag of claim 11, wherein the anti-microbial agent is impregnated in a strip applied to an inner wall of the front and/or rear face of the inner bag and/or the outer bag.

14. The liner bag of claim 13, wherein the strip indicates when the anti-microbial agent loses its effectiveness so that a user may know when to discontinue use of the liner bag.

15. The liner bag of claim 11, further comprising a temperature indicator strip applied to the inner bag and/or the outer bag for indicating a temperature of the heat transfer fluid.

16. The liner bag of claim 11, wherein the open top edges of the inner bag and the outer bag each include a zip-lock closure for sealing the inner and outer chambers.

17. A liner bag for warming a substance in a container, the liner bag comprising:

an inner bag comprising a front face, a rear face, closed side edges, a closed bottom, and an open top edge that cooperatively define an inner chamber for receiving and at least partially enclosing the container;

an outer bag comprising a front face, a rear face, closed side edges, a closed bottom, and an open sealable top edge that cooperatively define an outer chamber that at least partially encloses the inner bag and that receives and encloses a heat transfer fluid that transfers heat to the container, wherein the side edges of the inner bag are joined to the side edges of the outer bag but the front face, rear face, and closed bottom of the inner bag are not joined to the front face, rear face, and closed bottom of the outer bag so that the heat transfer fluid may flow between the outer bag and inner bag and at least partially surround the front face, rear face and closed bottoms of the inner bag for more effectively transferring heat to the inner bag and the container enclosed in the inner bag, and wherein the top edges of the outer bag and the inner bag have a width ranging from approximately 5 inches to approximately 7 inches, the closed bottoms have a width ranging from approximately 3 inches to approximately 5 inches, and the liner bag has a height ranging from approximately 7 inches to approximately 11 inches, and the bottom edges of the outer bag jacket and the inner bag are formed from material that is greater in thickness than the material of the rest of the liner bag;

an anti-microbial agent for disinfecting the heat transfer fluid placed in the outer chamber; and an indicator for indicating when the anti-microbial agent loses its effectiveness so that a user may know when to discontinue use of the liner bag.

18. The liner bag of claim 17, wherein the anti-microbial agent is impregnated in an inner wall of the front or rear face of the outer bag.

19. The liner bag of claim 17, wherein the anti-microbial agent is impregnated in the indicator.

20. The liner bag of claim 17, wherein at least a portion of the inner bag has a first color to indicate that the container should be placed therein and at least a portion of the outer bag has a second color to indicate that the heat transfer fluid should be placed therein.

21. A liner bag comprising:

an inner bag comprising a front face, a rear face, closed side edges, a closed bottom, and an open top edge that cooperatively define an inner chamber for receiving and at least partially enclosing a container; and an outer bag jacket around the inner bag and comprising a front face, a rear face, closed side edges, a closed bottom, and an open sealable top edge that cooperatively define an outer chamber that at least partially encloses the inner bag and that is configured for receiving a self-heating fluid that heats the inner bag and the container enclosed therein, wherein the top edges of the outer bag jacket and the inner bag have a width ranging from approximately 5 inches to approximately 7 inches, the closed bottoms have a width ranging from approximately 3 inches to approximately 5 inches, and the liner bag has a height ranging from approximately 7 inches to approximately 11 inches and the closed bottoms of the outer bag jacket and the inner bag are formed from material that is greater in thickness than the material of the rest of the liner bag.

22. The liner bag of claim 1, wherein the self-heating fluid is pre-loaded and sealed in the outer chamber of the outer bag.

23. The liner bag of claim 1, wherein the closed bottoms of the outer bag jacket and the inner bag are formed from material that is greater in stiffness than the material of the rest of the liner bag.

24. The liner bag of claim 1, further comprising a saucer attached to the bottom of the liner bag.

* * * * *